US008075994B2

(12) United States Patent
Sakamoto et al.

(10) Patent No.: US 8,075,994 B2
(45) Date of Patent: Dec. 13, 2011

(54) THERMAL BONDING CONJUGATE FIBER WITH EXCELLENT BULKINESS AND SOFTNESS, AND FIBER FORMED ARTICLE USING THE SAME

(75) Inventors: Kazuyuki Sakamoto, Osaka (JP); Tomoaki Suzuki, Osaka (JP); Hiroshi Kayama, Osaka (JP)

(73) Assignees: ES Fibervisions Co., Ltd., Osaka (JP); ES Fibervisions Hong Kong Limited, Kowloon (HK); ES Fibervisions LP, Athens, GA (US); ES Fibervisions APS, Verde (DK)

( * ) Notice: Subject to any disclaimer, the term of this patent is extended or adjusted under 35 U.S.C. 154(b) by 240 days.

(21) Appl. No.: 12/595,713

(22) PCT Filed: Apr. 24, 2008

(86) PCT No.: PCT/JP2008/058321

§ 371 (c)(1),
(2), (4) Date: Oct. 13, 2009

(87) PCT Pub. No.: WO2008/133348

PCT Pub. Date: Nov. 6, 2008

(65) Prior Publication Data

US 2010/0143717 A1 Jun. 10, 2010

(30) Foreign Application Priority Data

Apr. 25, 2007 (JP) ..... 2007-115552

(51) Int. Cl.
*D02G 3/00* (2006.01)

(52) U.S. Cl. ..... 428/373; 428/374; 428/370; 264/168

(58) Field of Classification Search ..... 428/370, 428/373, 374; 264/168
See application file for complete search history.

(56) References Cited

U.S. PATENT DOCUMENTS

| | | | | |
|---|---|---|---|---|
| 4,552,603 | A | 11/1985 | Harris, Jr. et al. | |
| 4,732,809 | A | 3/1988 | Harris, Jr. et al. | |
| 4,814,032 | A | 3/1989 | Taniguchi et al. | |
| 5,106,552 | A | 4/1992 | Goi et al. | |
| 5,693,420 | A * | 12/1997 | Terada et al. | 428/370 |
| 5,866,480 | A * | 2/1999 | Murakami et al. | 438/693 |
| 5,866,488 | A | 2/1999 | Terada et al. | |
| 6,410,139 | B1 * | 6/2002 | Tsutsui et al. | 428/373 |
| 6,492,475 | B1 * | 12/2002 | Egashira et al. | 526/153 |
| 6,495,255 | B2 * | 12/2002 | Tsutsui et al. | 428/370 |
| 6,617,023 | B2 * | 9/2003 | Tsutsui et al. | 428/370 |
| 2002/0037408 | A1 * | 3/2002 | Tsutsui et al. | 428/373 |
| 2010/0143717 | A1 * | 6/2010 | Sakamoto et al. | 428/373 |

FOREIGN PATENT DOCUMENTS

| | | |
|---|---|---|
| EP | 0269051 | 6/1988 |
| GB | 2096048 | 10/1982 |
| JP | 63-135549 | 6/1988 |
| JP | 63-282312 | 11/1988 |
| JP | 1-246417 | 10/1989 |
| JP | 3-21648 | 3/1991 |
| JP | 8-246246 | 9/1996 |
| JP | 9-49122 | 2/1997 |
| JP | 2000-336526 | 12/2000 |
| JP | 2003-003334 | 1/2003 |

* cited by examiner

*Primary Examiner* — N. Edwards
(74) *Attorney, Agent, or Firm* — Hamre, Schumann, Mueller & Larson, P.C.

(57) ABSTRACT

A thermal bonding conjugate fiber constituted from a first component comprising a polyester resin and a second component comprising a polyolefin resin with a melting point lower than that of the polyester resin by not less than 20° C., characterized in that a post-heat treatment bulk retention rate thereof is 20% or more when calculated by the following measurement method: Bulk retention rate=(H1 (mm)/H0 (mm))×100(%) (wherein H0 is the web height when a 0.1 g/cm$^2$ load is applied to a web with a mass per unit area of 200 g/m$^2$; and H1 is the web height after a heat treatment for 5 min at 145° C. when a 0.1 g/cm$^2$ load is applied to that web).

8 Claims, No Drawings

THERMAL BONDING CONJUGATE FIBER WITH EXCELLENT BULKINESS AND SOFTNESS, AND FIBER FORMED ARTICLE USING THE SAME

TECHNICAL FIELD

The present invention relates to a thermal bonding conjugate fiber, more particularly to a thermal bonding conjugate fiber with excellent bulkiness and softness for uses in absorbent articles such as diapers, napkins, pads or the like, medical hygiene supplies, daily living-related materials, general medical supplies, bedding materials, filter materials, nursing care products, and pet products or the like, and relates to a process for producing the same, and to a fiber formed article using the same.

BACKGROUND ART

Thermal bonding conjugate fibers can be processed by heat fusion bonding utilizing thermal energy such as hot air or a heated roll and the like, and these fibers can be widely used for hygiene supplies such as diapers, napkins, pads, etc., articles for daily living, or industrial supply materials such as filters and the like because bulkiness and softness are easily obtained thereby. Bulkiness and softness are extremely important, especially in hygiene supplies because they are items in direct contact with the human skin and because body fluids such as urine, menstrual flow, and the like must be quickly absorbed thereby. Typical means of obtaining bulkiness involve using a highly rigid resin or using a fiber with increased fineness, but in such cases the softness thereof is decreased, and the physical irritation toward the skin is increased. On the other hand, when softness is given priority to control the irritation of the skin, a nonwoven fabric with inferior body fluid absorption results because bulkiness, and especially the cushioning effect with respect to body weight, is markedly decreased.

As a result, many methods have been proposed for obtaining a fiber and nonwoven fabric that has both bulkiness and softness. For example, in Japanese Patent Application Publication No. S63-135549, a process for producing a nonwoven fabric with a high level of bulkiness has been disclosed involving a sheath-core conjugate fabric wherein a polypropylene with a high degree of isotacticity forms the core member, and a resin comprising mainly polyethylene forms the sheath member. This process is one imparting bulkiness to the obtained nonwoven fabric by using a highly rigid resin for the core member of the conjugate fiber, but the softness thereof is unsatisfactory; moreover, the bulkiness of the nonwoven fabric obtained thereby is decreased, especially if the thermal bonding temperature is high, making it almost impossible to obtain both properties with this process.

For example, in Japanese Patent Application Publication No. 2000-336526 and Japanese Patent published and examined Application No. H3-21648, methods have been proposed for imparting bulkiness using a polyester in the core member and polyethylene or polypropylene in the sheath member. In the case of Japanese Patent Application Publication No. 2000-336526, a sheath-core conjugate fiber using polyolefin for the sheath member and a polyester with a melting point ≧20° C. higher than that of the aforementioned polyolefin for the core member is heat-treated after drawing and crimping, and the heat treatment is performed with hot air at a temperature ≧10° C. higher than the glass transition temperature of the aforementioned polyester, but lower by 20° C. or more than the melting point of the aforementioned polyolefin to impart softness and bulkiness to a nonwoven fabric. However, when the fiber is fabricated into a nonwoven fabric, during the process of performing thermal bonding at a temperature equal to or greater than the melting point of the polyolefin, a decrease in thickness occurs due to relaxation of the crimp, shrinkage, and the like because the crimped form is not sufficiently stable with respect to heat, and it is almost impossible to obtain a bulky nonwoven fabric.

In the case of Japanese Patent published and examined Application No. H3-21648, on the other hand, bulkiness is imparted to a nonwoven fabric by using a polyethylene or polypropylene for the latently adhesive component and a polyester for the other, and a conditioning heat treatment is performed at a preselected temperature range after drawing and crimping, and although bulkiness was superb in this case, the softness of the nonwoven fabric obtained thereby was insufficient. In addition, because relaxation of the crimping sometimes occurs in the conditioning step of this method, the crimped form was still lacking in stability.

DISCLOSURE OF THE INVENTION

An object of the present invention is to provide a thermal bonding conjugate fiber that maintains crimped form stability during thermal bonding when fabricating a nonwoven fabric therefrom, and that imparts not only bulkiness and bulk recovery to the nonwoven fabric, but also excellent softness thereto; and a fiber formed article using the same.

The inventors diligently investigated the above problem. As a result, they discovered that a fiber having the following constitution solves the above problems, and they completed the present invention based on that knowledge. The present invention has the following features.

[1] A thermal bonding conjugate fiber constituted from a first component comprising a polyester resin and a second component comprising a polyolefin resin with a melting point lower than that of the above polyester resin by not less than 20° C., characterized in that a post-heat treatment bulk retention rate thereof is 20% or more when calculated by the following measurement method:

$$\text{Bulk retention rate}=(H_1\ (\text{mm})/H_0\ (\text{mm}))\times 100\ (\%)$$

(wherein $H_0$ is the web height when a 0.1 g/cm$^2$ load is applied to a web with a mass per unit of area of 200 g/m$^2$; and $H_1$ is the web height after a heat treatment for 5 min at 145° C. when a 0.1 g/cm$^2$ load is applied to that web).

[2] The thermal bonding conjugate fiber of [1] above, characterized in that the shrinkage rate after heat treatment is not more than 3% when calculated by the following measurement method:

$$\text{Shrinkage rate}=\{(25\ (\text{cm})-h_1\ (\text{cm}))/25\ (\text{cm})\}\times 100\ (\%)$$

(wherein $h_1$ is the vertical or horizontal length, which ever is the shorter length, after a heat treatment for 5 min at 145° C. of a 25 cm×25 cm web with a mass per unit area of 200 g/m$^2$).

[3] The thermal bonding conjugate fiber of [1] or [2] above, characterized in that the content of inorganic fine particles in the thermal bonding conjugate fiber is 0.3 to 10 wt %.

[4] The thermal bonding conjugate fiber of any one of [1] to [3] above, characterized in that the polyester resin constituting the first component is at least one selected from the group consisting of polyethylene terephthalate, polypropylene terephthalate, polybutylene terephthalate, polylactic acid, and polybutylene adipate terephthalate.

[5] The thermal bonding conjugate fiber of any one of [1] to [4] above characterized in that the polyolefin resin constituting the second component is at least one selected from the group consisting of polyethylene, polypropylene, and a copolymer having propylene as the main component thereof.

[6] The thermal bonding conjugate fiber of any one of [1] to [5] above, characterized in that the fiber fineness of the above thermal bonding conjugate fiber is 0.9 to 8.0 dtex.

[7] The thermal bonding conjugate fiber of any one of [1] to [6] above, characterized in that the cross-sectional shape of the above thermal bonding conjugate fiber is an eccentric cross-section.

The present invention is also directed to a process for producing the thermal bonding conjugate fiber. More specifically, the present invention provides a process for producing a thermal bonding conjugate fiber containing inorganic fine particles comprising; adding inorganic fine particles to the first component and/or second component resin and then performing spinning; establishing a draw ratio of 75 to 90% of the break-draw ratio of the undrawn fibers and establishing a heating temperature in the range of from not less than the glass transition temperature (Tg) of the first component plus 10° C. to not more than the melting point of the second component minus 10° C., and then performing drawing and crimping; and performing a heat treatment at a temperature lower than the melting point of the second component, but not lower in excess of 15° C. than the melting point thereof.

The thermal bonding conjugate fiber of the present invention maintains crimped form stability even during thermal bonding when producing a nonwoven fabric therefrom because the bulk retention rate is held at 20% or higher after heat treatment, thereby enabling preparation of a nonwoven fabric not only with a high level of softness but also with excellent bulkiness and bulk recovery.

BEST MODE FOR CARRYING OUT THE INVENTION

The present invention is explained in greater detail below.

The thermal bonding conjugate fiber of the present invention is characterized in that a thermal bonding conjugate fiber constituted from a first component comprising a polyester resin and a second component comprising a polyolefin resin with a melting point lower than that of the above polyester resin by not less than 20° C., and a post-heat treatment bulk retention rate is 20% or more when calculated by the following measurement method:

$$\text{Bulk retention rate}=(H_1\ (\text{mm})/H_0\ (\text{mm}))\times 100\ (\%)$$

wherein $H_0$ is the web height when a 0.1 g/cm$^2$ load is applied to a web with a mass per unit area of 200 g/m$^2$; and $H_1$ is the web height after a heat treatment for 5 min at 145° C. when a 0.1 g/cm$^2$ load is applied to that web.

The polyester resin constituting the thermal bonding conjugate fiber of the present invention (also simply referred to as the conjugate fiber below) can be obtained by condensation polymerization of a diol and a dicarboxylic acid. Examples of the dicarboxylic acid used in the condensation polymerization of the polyester include terephthalic acid, isoterephthalic acid, 2,6-naphthalene dicarboxylic acid, adipic acid, sebacic acid, and the like. Examples of the diol used include ethylene glycol, diethylene glycol, 1,3-propane diol, 1,4-butane diol, neopentyl glycol, 1,4-cyclohexane dimethanol, and the like. Polyethylene terephthalate, polypropylene terephthalate, and polybutylene terephthalate are preferably used as the polyester resin in the present invention. Instead of the above aromatic polyesters, an aliphatic polyester can also be used, and examples of preferred resins include polylactic acid and polybutylene adipate terephthalate. These polyester resins may be used not only as a homopolymer, but as a copolymer polyester (co-polyester). In such a case, a dicarboxylic acid such as adipic acid, sebacic acid, phthalic acid, isophthalic acid, 2,6-naphthalene dicarboxylic acid and the like; a diol such as diethylene glycol, neopentyl glycol and the like; or an optical isomer such as L-lactic acid and the like can be used as a copolymer component thereof. In addition, two or more types of these polyester resins may be mixed and used together.

The polyolefin resin that can be used in the present invention includes a high density polyethylene, linear low density polyethylene, low density polyethylene, polypropylene (propylene homopolymer), ethylene-propylene copolymer having propylene as the main component thereof, ethylene-propylene-butene-1 copolymer having propylene as the main component thereof, polybutene-1, polyhexene-1, polyoctene-1, poly 4-methyl pentene-1, polymethyl pentene, 1,2-polybutadiene, 1,4-polybutadiene and the like. Furthermore, a small amount of α-olefin such as ethylene, butene-1, hexene-1, octene-1 or 4-methyl pentene-1 and the like may be contained in these homopolymers as a copolymer component in addition to the monomer constituting the homopolymer. Moreover, a small amount of another ethylenically unsaturated monomer such as butadiene, isoprene, 1,3-pentadiene, styrene, α-methyl styrene and the like may be contained as a copolymer component. Additionally, 2 or more types of the aforementioned polyolefin resins may be mixed together and used. Not only polyolefin resins polymerized by a conventional Ziegler-Natta catalyst, but also polyolefin resins polymerized by a metallocene catalyst and copolymers thereof can be preferably used therefor. Finally, the melt flow rate (hereinafter, MFR) of a polyolefin resin that can be suitably used is not particularly limited in the present invention provided it lies within the spinnable range, but an MFR of 1 to 100 g/10 min is preferred, and 5 to 70 g/10 min is more preferred.

The present invention does not limit the properties of the polyolefin resin other than the aforementioned MFR, e.g., the Q value (weight average molecular weight/number average molecular weight), Rockwell hardness, number of branching methyl chains, and the like provided the requirements of the present invention are satisfied thereby.

Examples of a preferred combination of the first component/second component in the present invention include the following:

polypropylene/polyethylene terephthalate; high density polyethylene/polyethylene terephthalate; linear low density polyethylene/polyethylene terephthalate; and low density polyethylene/polyethylene terephthalate. Instead of polyethylene terephthalate, polybutylene terephthalate, polytrimethylene terephthalate, and polylactic acid may also be used.

Additives such as an antioxidant, photostabilizing agent, UV absorbing agent, neutralizing agent, nucleating agent, epoxy stabilizer, lubricant, antibacterial agent, flame retardant, antistatic agent, pigment, plasticizer, and the like may be added to the thermoplastic resin used in the present invention as needed within a range that does not interfere with the effect of the present invention.

The conjugate fiber of the present invention can be obtained by a process in which, for example, after undrawn fibers are obtained by melt spinning using the first component and second component above, it is possible to impart crimping in a crimping step after partially oriented crystallization progresses in a drawing step, and then perform the heat treatment for a set time at the specified temperature using a hot air dryer and the like to proceed with crystallization.

Next, the post-heat treatment bulk retention rate that is a constituent feature of the present invention will be explained. The bulkiness of a thermal bonded nonwoven fabric is determined from fiber properties such as fineness, cross-sectional shape, crimped form and the like, and from the intrinsic properties of the resin such as the melting point, molecular weight, degree of crystallization and the like of the thermoplastic resin constituting the conjugate fiber. However, a phenomenon wherein sufficient bulkiness is not obtained has sometimes been found even if a thermal bonded nonwoven fabric is actually fabricated using a conjugate fiber satisfying these properties. Therefore, as a result of various types of tests that were conducted, the stability of the crimped form enabling the crimp to be retained even under the temperature conditions of thermal bonding has been identified as one factor for determining bulkiness, and that led to proposing the following indicator as a mean whereby this factor can be verified.

$$\text{Bulk retention rate}=(H_1\ (\text{mm})/H_0\ (\text{mm}))\times 100\ (\%)$$

In this formula, $H_0$ is the web height when a 0.1 g/cm$^2$ load is applied to a web with a mass per unit area of 200 g/m$^2$; and $H_1$ is the web height after a heat treatment for 5 min at 145° C. when a 0.1 g/cm$^2$ load is applied to that web.

If the crimp has a high level of stability with respect to heat, the post-heating web height $H_1$ will also be sufficiently high. As a result of testing the relationship between the above measurement method and the bulkiness of nonwoven fabrics that were actually produced, it was determined that if the calculated post-heat treatment bulk retention rate is 20% or higher, preferably 25% or higher, then a nonwoven fabric with excellent bulkiness and bulk recovery can be obtained.

In conventional means, crystallization has been advanced by applying a sufficiently high temperature (lower than the melting point of the thermal bonding component by not less than 5° C.) in the heat treatment step subsequent to imparting the crimp with the intention of obtaining highly rigid fibers with excellent bulk recovery. However, if the form stability of the crimp imparted prior to the heat treatment step is insufficient, relaxation of crimps and decrease of stiffness of crimps occur during the heat treatment step, and it becomes difficult to impart bulkiness to the nonwoven fabric. For example, when measures such as increasing the draw ratio, raising the heating temperature, and the like are taken to obtain sufficient fiber strength in the drawing step, oriented crystallization proceeds too far before the crimping step, and it becomes difficult to obtain a stiff crimp. Therefore, the crimped form stability is not retained under the high temperature conditions of the heat treatment step. Conversely, when the draw ratio and heating temperature are decreased to suppress oriented crystallization, undesirable results occur such as heat shrinkage in the heat treatment step, decrease in fiber strength, and the like.

Therefore, by partly suppressed oriented crystallization in the steps from drawing to crimping, imparting a rigid crimp wherein fiber strength is retained, and wherein relaxation of the crimp and heat shrinkage in subsequent steps are unlikely to occur, and advancing crystallization again in the subsequent heat treatment step, it is easy to retain the crimp even in the thermal bonding step during fabrication of the nonwoven fabric, and it becomes possible to obtain a nonwoven fabric with excellent bulkiness and bulk recovery. More specifically, in the steps from drawing to crimping it is preferable to establish a draw ratio at 75 to 95% of the break-draw ratio of undrawn fibers and to establish a heating temperature in the range of from not less than the glass transition temperature (Tg) of the first component plus 10° C. to not more than the melting point of the second component minus 10° C. Thereafter, it is preferable to perform the heat treatment at a temperature lower than the melting point of the second component, but ≦15° C. lower than the melting point thereof, and more preferably at a temperature lower than the melting point of the second component, but ≦10° C. lower than the melting point thereof in order to advance crystallization. For the heat treatment a publicly known means such as a hot air circulating dryer, hot air flow-through heat treatment apparatus, relaxing hot air dryer, hot plate compression bonding dryer, drum dryer, infrared dryer and the like can be used.

If heat shrinkage during the nonwoven fiber fabrication step occurs, because it will interfere with the crimped form stability, it is preferable that the post-heat treatment shrinkage rate is not more than 3% when calculated by the following measurement method:

$$\text{Shrinkage rate}=\{(25\ (\text{cm})-h_1\ (\text{cm}))/25\ (\text{cm})\}\times 100\ (\%)$$

wherein $h_1$ is the vertical or horizontal length, which ever is the shorter length, after a heat treatment for 5 min at 145° C. of a 25 cm×25 cm web with a mass per unit area of 200 g/m$^2$.

An example of a preferred means for achieving the conditions of the present invention is a means wherein at least a predetermined amount of inorganic fine particles such as titanium dioxide is added to the fibers. When forming fibers by winding molten resin discharged in the melt spinning step, oriented crystallization is promoted by the cooling conditions, tension applied to the fiber axis during solidification, and the like. It is believed that if inorganic fine particles such as titanium dioxide are added, the oriented crystallization is partly inhibited thereby. Therefore, even when measures such as increasing the draw ratio and the heating temperature in the drawing step and the like are taken, the fiber easily arrives at the crimping step in a state wherein oriented crystallization is partly suppressed due to the inorganic fine particles, and thus it is possible to impart a crimp with a stiff set.

Among inorganic fine particles, fibers with excellent softness can be obtained with titanium dioxide particles having a high specific gravity of 3.7 to 4.3 because they impart draping characteristics due to their own weight and a smooth touch, and they produce gaps such as voids, cracks, and the like on the inside and surface of the fibers. Because the occurrence of gaps such as voids, cracks, and the like on the inside and surface of the fibers can easily bring about a decrease in fiber strength, it was believed that inorganic fine particles were not very desirable for achieving the conditions of the present invention, however a reduction in the voids, cracks, and the like together with crystallization can be achieved by applying a sufficiently high temperature in the heat treatment step. As a result, it is possible to obtain thermal bonding conjugate fibers having excellent bulkiness and bulk recovery, as well as softness, without decreasing the fiber strength. In other words, as a result of the synergistic action with the other constituent features of the present invention brought about by the addition of inorganic fine particles, the conjugate fiber of the present invention provides an advantage that could not be predicted from the original effect of adding inorganic fine particles, i.e., combining bulkiness, bulk recovery, and especially softness while also realizing the advantages of crimped shape stiffness and enhanced thermal stability achieved by performing drawing at a high draw ratio and a high heating temperature.

The present invention does not particularly limit the inorganic fine particles used therein provided they have a high specific gravity and are unlikely to clump together in the molten resin. Examples thereof include zinc oxide (specific gravity 5.2 to 5.7), barium titanate (specific gravity 5.5 to 5.6), barium carbonate (specific gravity 4.3 to 4.4), barium sulfate (specific gravity 4.2 to 4.6), zirconium oxide (specific gravity 5.5), zirconium silicate (specific gravity 4.7), alumina (specific gravity 3.7 to 3.9), magnesium oxide (specific gravity 3.2) or a substance having essentially the same specific gravity, and among these alternatives the use of titanium dioxide and zinc oxide is preferred.

The inorganic fine particles used in the present invention are preferably contained therein in the range of 0.3 to 10 wt %, more preferably, 0.5 to 5 wt %, and even more preferably, 0.8 to 5 wt % with respect to the weight of the thermal bonding conjugate fiber of the present invention. A content of 0.3 wt % or higher is preferred because sufficient softness can be realized thereby. On the other hand, when the content is 10 wt % or lower, deterioration of spinning properties, decrease of fiber strength, and discoloration do not occur, and excellent productivity and quality stability can be maintained. Provided the inorganic fine particles are preferably contained in the range of 0.3 to 10 wt % with respect to the weight of the thermal bonding conjugate fiber of the present invention, they can be added only to the first component, only to the second component, or to both components, but adding the inorganic fine particles at least to the first component is preferred from the standpoint of facilitating strength retention after the nonwoven fabric is fabricated. Examples of a method of adding the inorganic fine particles include a method wherein a powder is directly added to the first component and the second component, or a method wherein a master batch is prepared and kneaded into the resin and the like.

The resin used to prepare the master batch is most preferably the same resin as the resin of the first component and second component, but the present invention does not particularly limit this resin provided it satisfies the conditions of the present invention, and a resin different from the first component and second component may also be used.

Examples of methods for verifying qualitatively and quantitatively the mix ratio of the content of inorganic fine particles in the present invention include methods wherein surface analysis is performed by X-ray fluorescence or photoelectron spectroscopy of the inorganic fine particles exposed on the surface of the fibers; methods involving dissolution using a solvent capable of dissolving the thermoplastic resin constituting the fibers, filtering the inorganic fine particles contained in the solution, separating the same by a means such as centrifugal separation and the like, and then performing elemental analysis by a means such as the surface analysis noted above and atomic absorption spectroscopy, ICP (high frequency inductively coupled plasma) emission spectroscopy, and the like. Naturally, the present invention is not limited to these exemplary methods, and verification can be performed by other means. Furthermore, combining these means is preferred because it facilitates determining whether the inorganics contained therein are of a single type or a mixture of a plurality of inorganic fine particles.

Examples of the cross-sectional shape of the thermal bonding conjugate fiber of the present invention include concentric sheath-core, side-by-side, eccentric sheath-core, concentric hollow, side-by-side hollow, eccentric hollow, multilayer, radial, sea-island and other shapes. Not only a circular cross-sectional shape but also a variant cross-sectional shape (non-circular cross-sectional shape) can be used. Examples of variant cross-sectional shapes include, for example, star, elliptical, triangular, quadrangular, pentagonal, multilobe, array, T-shaped, horseshoe shaped and the like. From the standpoint of ease of imparting form stability to the crimp and the ease of obtaining balance between bulkiness and strength in the nonwoven fabric, preferred shapes are concentric sheath-core, side-by-side, eccentric sheath-core, concentric hollow, side-by-side hollow, and eccentric hollow, and among these alternatives concentric sheath-core, eccentric sheath-core, concentric hollow, and eccentric hollow cross-sectional shapes are even more preferred. In addition, eccentric cross-sectional shapes, particularly an eccentric sheath-core and eccentric hollow shape, are preferred because in the heat treatment step they exhibit spontaneous crimping due to the difference in elastic contraction between the first component and the second component.

In the thermal bonding conjugate fiber of the present invention the conjugate rate of the first component to the second component preferably lies within the range of 10/90 volume % to 90/10 volume %, and more preferably within the range of 30/70 volume % to 70/30 volume %. By establishing a conjugate rate of this range the cross-sectional shape will be one wherein both components are uniformly located. The unit for conjugate rate in the explanation below is percent by volume.

The fineness of the thermal bonding conjugate fiber according to the present invention is preferably 0.9 to 8 dtex, more preferably 1.1 to 6.0 dtex, and even more preferably 1.5 to 4.4 dtex. By establishing this range for fineness both bulkiness and softness can be obtained.

Because the thermal bonding conjugate fiber obtained in this manner is able to retain crimped form stability even during thermal bonding in the processing procedure, it not only has excellent bulkiness and bulk recovery, but also excellent softness. As a result, it can be used to fabricate a net, web, knit fabric, nonwoven fabric and the like, and in particular it is preferably used for a nonwoven fabric. Publicly known methods such as the thermal bonding method (through air method, point bonding method and the like), airlaid method, needle punch method, water jet method and the like can be used for producing the nonwoven fabric. In addition, fibers blended by a method such as cotton blend, spin blend, fiber blend, twisted union, twisted stitch, twisted fiber, and the like can be made into the form of a fabric by the aforementioned methods for manufacturing a nonwoven fabric.

Suitable uses for a fiber formed article using the thermal bonding conjugate fiber of the present invention include absorbent articles such as diapers, napkins, incontinence pads, etc.; medical hygiene supplies such as gowns, scrubs, etc.; interior furnishing materials such as wall coverings, Japanese translucent sliding window paper, floor coverings, etc.; daily living-related materials such as various covering cloths, cleaning wipes, garbage container coverings, etc.; toilet related products such as disposable toilets, toilet seat covers, etc.; pet products such as pet sheets, pet diapers, pet towels, etc.; industrial supplies such as wiping materials, filters, cushioning materials, oil adsorbents, ink tank adsorbents, etc.; general medical supplies; bedding materials; nursing care products, and so forth requiring both bulkiness and softness.

EXAMPLES

The present invention is described in greater detail below through examples, but the present invention is by no means limited thereto. The evaluations of properties in each example were preformed in accordance with the following methods.

(Thermoplastic Resin)

The following thermoplastic resins were used as the thermoplastic resin constituting the fiber.

Resin 1: High density polyethylene (abbreviated as PE) with a density of 0.96 g/cm$^3$, MFR (at 190° C. and a load of 21.18 N) of 16 g/10 min, and melting point of 130° C.

Resin 2: Crystalline polypropylene (abbreviated as PP) with an MFR (at 230° C. and a load of 21.18 N) of 5 g/10 min, and melting point of 162° C.

Resin 3: Ethylene-propylene-1-butene tercopolymer containing 4.0 wt % ethylene and 2.65 wt % 1-butene (abbreviated as co-PP) with an MFR (at 230° C. and a load of 21.18 N) of 16 g/10 min, and melting point of 131° C.

Resin 4: Polyethylene terephthalate (abbreviated as PET) with an intrinsic viscosity of 0.65, and a glass transition temperature of 70° C.

Resin 5: Polytrimethylene terephthalate (abbreviated as PTT) with an intrinsic viscosity of 0.92.

Resin 6: Polylactic acid ("U' z S-17" manufactured by Toyota Motor Corporation) with an MFR (at 190° C. and a load of 21.18 N) of 13.5 g/10 min, and a melting point of 175° C.

Tables 1 to 3 show the resins and combinations thereof used in the fiber.

(Inorganic Fine Particle Addition Method)

The following methods were used to add the inorganic fine particles to the fiber.

After a master batch of powder of inorganic fine particles was prepared, the particles were added to the first component and/or the second component. The resins used for making the master batch were the same resins as the first component and the second component.

(Melt Flow Rate (MFR) Measurement)

The melt flow rate was measured in accordance with JIS K 7210. The MI was measured in accordance with Condition D (test temperature of 190° C., load 2.16 kg) of Appendix A, Table 1, and the MFR was measured in accordance with Condition M (test temperature 230° C., load 2.16 kg).

(Bulk Retention Rate)

Using a 500 mm roller carding test machine manufactured by Daiwa-kiko Corporation Ltd., approximately 100 g of test sample fiber was made into a carded web at a drum speed of 432 m/min and a doffer speed of 7.2 m/min (speed ratio: 60:1), and then wound at a drum speed of 7.5 m/rain to make a web with a mass per unit area of 200 g/m$^2$. This web was cut into a 25 cm×25 cm square, and the mean value of the height on four sides measured under a load of 0.1 g/cm$^2$ was used as $H_0$ (cm). Then, in that condition a heat treatment was performed thereon for 5 min at 145° C. using a commercial hot air circulating dryer.

After the post-heat treatment carded web was let stand to cool, measurements were taken at the same locations on the four sides for the measurement of $H_0$, the mean value thereof $H_1$ (cm) was determined, and the bulk retention rate was calculated using the following formula.

$$\text{Bulk retention rate}=(H_1\ (\text{mm})/H_0\ (\text{mm}))\times 100\ (\%)$$

(Shrinkage Rate)

A sample fiber was made into a carded web on the same roller carding test machine under the same conditions as described above, and a web with a mass per unit area of 200 g/m$^2$ was fabricated. This web was cut into a vertical 25 cm×horizontal 25 cm square, and in that condition a heat treatment was performed thereon for 5 min at 145° C. using a commercial hot air circulating dryer.

After the post-heat treatment carded web was let stand to cool, measurements were taken at 3 different locations in either the vertical or horizontal direction, whichever was shorter, the mean value $h_1$ (cm) was determined, and the shrinkage rate was calculated from the following formula.

$$\text{Shrinkage rate}=\{(25\ (\text{cm})-h_1\ (\text{cm}))/25\ (\text{cm})\}\times 100\ (\%)$$

(Softness)

Ten monitors were asked to touch the nonwoven fabrics and evaluate the softness thereof from the standpoint of surface smoothness, cushioning properties, draping characteristics and the like. The results of the evaluation were scored as follows.

A: Eight or more monitors considered the softness excellent.

B: Six or more monitors considered the softness excellent.

C: Four or more monitors considered the softness excellent.

D: Two or fewer monitors considered the softness excellent.

(Manufacture of Fiber)

Using the thermoplastic resins shown in Tables 1 to 3, the first component was arrayed as the core and the second component was arrayed as the sheath. Spinning was performed in the same manner at the extrusion temperatures, composition ratios (content ratios) and cross-sectional shapes shown in Tables 1 to 3, and during that process a fiber treatment agent having potassium alkyl phosphate as the main component thereof was brought into contact with the oiling roll and attached to the fiber. A drawing temperature (heated roll surface temperature) of 90° C. was established, and the undrawn fibers obtained thereby were advanced from the drawing step through the crimping step under the conditions shown in Tables 1 to 3. Then a heat treatment was performed for 5 min at the heat treatment temperatures shown in Tables 1 and 2 using a hot air circulating dryer to obtain fibers. Next, the fibers were cut using a cutter to make short fibers, and these were used as the test sample fibers. The test sample fibers obtained thereby were fabricated into a carded web with a mass per unit area of 200 g/m$^2$ using a roller carding test machine, and used for measuring the bulk retention rate and shrinkage rate.

(Nonwoven Fabric)

The test sample fibers obtained in the above process were made into a carded web using a different roller carding test machine, and this web was through-air (abbreviated as TA) processed at 130° C. using a suction dryer to obtain nonwoven fabric with a mass per unit area of 25 g/m$^2$.

Examples 1 to 12 and Comparative Examples 1 to 4

Conjugate fibers and nonwoven fabrics using the same were obtained under the conditions shown in Tables 1 to 3, and the performance thereof was evaluated and measured based on the above evaluation methods. The results are shown in Tables 1 to 3.

TABLE 1

| | | Ex. 1 | Ex. 2 | Ex. 3 | Ex. 4 | Ex. 5 | Ex. 6 |
|---|---|---|---|---|---|---|---|
| First component | Resin | PET | PET | PET | PET | PTT | Polylactic acid |
| | Intrinsic viscosity (η) | 0.64 | 0.64 | 0.64 | 0.64 | 0.92 | — |
| | Melting point (° C.) | 255 | 255 | 255 | 255 | 228 | 175 |
| | Extrusion temp. (° C.) | 305 | 305 | 305 | 305 | 280 | 240 |

TABLE 1-continued

| | | Ex. 1 | Ex. 2 | Ex. 3 | Ex. 4 | Ex. 5 | Ex. 6 |
|---|---|---|---|---|---|---|---|
| Second component | Resin | PE | PE | PE | PE | PE | PE |
| | MFR (g/10 min) | 16 | 16 | 16 | 16 | 16 | 16 |
| | Melting point (° C.) | 130 | 130 | 130 | 130 | 130 | 130 |
| | Extrusion temp. (° C.) | 230 | 230 | 230 | 230 | 230 | 230 |
| Production conditions | Spinning fineness (dtex) | 8.6 | 8.6 | 6.5 | 12 | 5.6 | 7.5 |
| | Draw ratio | 3.4 | 3.4 | 4.3 | 3.4 | 3 | 4 |
| | Heat treatment temp. (° C.) | 120 | 120 | 120 | 122 | 120 | 125 |
| Fiber properties | Fineness based on corrected mass (dtex) | 3.3 | 3.3 | 1.8 | 4.4 | 2.2 | 2.2 |
| | Conjugate rate (1st/2nd) | 60/40 | 40/60 | 50/50 | 60/40 | 50/50 | 50/50 |
| | Additive | $TiO_2$ | $TiO_2$ | $TiO_2$ | $TiO_2$ | $TiO_2$ | $TiO_2$ |
| | Addition rate (1st/2nd: %) | 2/3 | 2/3 | 4/0 | 2/3 | 1/0 | 1/0 |
| | Fiber cross-section | CSC* | ESC* | CSC* | CSC* | CSC* | CSC* |
| | Cross-sectional shape | 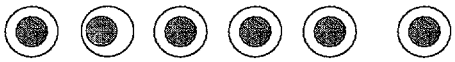 | | | | | |
| | Cut length (mm) | 38 | 51 | 45 | 38 | 51 | 51 |
| | Bulk retention rate (%) | 25 | 30 | 22 | 27 | 26 | 21 |
| | Shrinkage rate (%) | 1 | 0 | 0.8 | 1.2 | 3 | 2 |
| Nonwoven fabric properties | Mass per unit area ($g/m^2$) | 25 | 25 | 27 | 25 | 25 | 25 |
| | Thickness (mm) | 2.8 | 2.6 | 2.3 | 3 | 2.8 | 2.2 |
| | Specific volume ($cm^3/g$) | 110 | 105 | 85 | 118 | 110 | 88 |
| | Softness | A | A | A | B | A | B |

*CSC: Concentric sheath core, ESC: Eccentric sheath core

TABLE 2

| | | Ex. 7 | Ex. 8 | Ex. 9 | Ex. 10 | Ex. 11 | Ex. 12 |
|---|---|---|---|---|---|---|---|
| First component | Resin | PET | PET | PET | PET | PET | PET |
| | Intrinsic viscosity (η) | 0.64 | 0.64 | 0.64 | 0.64 | 0.64 | 0.64 |
| | Melting point (° C.) | 255 | 255 | 255 | 255 | 255 | 255 |
| | Extrusion temp. (° C.) | 305 | 305 | 305 | 305 | 305 | 305 |
| Second component | Resin | PE | PE | PE | Co-PP | PE | PE |
| | MFR (g/10 min) | 16 | 16 | 16 | 16 | 16 | 16 |
| | Melting point (° C.) | 130 | 130 | 130 | 131 | 130 | 130 |
| | Extrusion temp. (° C.) | 230 | 230 | 230 | 260 | 230 | 230 |
| Production conditions | Spinning fineness (dtex) | 6.8 | 7.9 | 18.5 | 7.1 | 5.6 | 8.4 |
| | Draw ratio | 3 | 3 | 3.9 | 3.2 | 3 | 3.2 |
| | Heat treatment temp. (° C.) | 120 | 120 | 120 | 115 | 120 | 120 |
| Fiber properties | Fineness based on corrected mass (dtex) | 2.8 | 3.3 | 5.6 | 2.6 | 2.2 | 3.3 |
| | Conjugate rate (1st/2nd) | 40/60 | 50/50 | 50/50 | 50/50 | 50/50 | 60/40 |
| | Additive | $TiO_2$ | $TiO_2$ | $TiO_2$ | $TiO_2$ | ZnO | — |
| | Addition rate (1st/2nd: %) | 2/3 | 2/3 | 6/0 | 2/0 | 0.5/5 | — |
| | Fiber cross-section | CH* | EH* | ESC* | CSC* | CSC* | CSC* |
| | Cross-sectional shape | 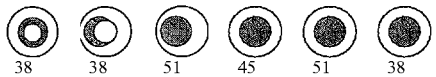 | | | | | |
| | Cut length (mm) | 38 | 38 | 51 | 45 | 51 | 38 |
| | Bulk retention rate (%) | 28 | 33 | 32 | 21 | 23 | 23 |
| | Shrinkage rate (%) | 0 | 1 | 0 | 5 | 1 | 0 |
| Nonwoven fabric properties | Mass per unit area ($g/m^2$) | 25 | 25 | 25 | 25 | 26 | 25 |
| | Thickness (mm) | 2.7 | 3.1 | 3.4 | 2.4 | 2.6 | 2.9 |
| | Specific volume ($cm^3/g$) | 108 | 125 | 135 | 96 | 100 | 116 |
| | Softness | A | A | A | B | B | C |

*CH: Concentric hollow, EH: Eccentric hollow, ESC: Eccentric sheath core, CSC: Concentric sheath core

TABLE 3

| | | Comp. Ex. 1 | Comp. Ex. 2 | Comp. Ex. 3 | Comp. Ex. 4 |
|---|---|---|---|---|---|
| First component | Resin | PET | PET | PET | PP |
| | Intrinsic viscosity (η) | 0.64 | 0.64 | 0.64 | — |
| | Melting point (° C.) | 255 | 255 | 255 | 162 |
| | Extrusion temp. (° C.) | 305 | 305 | 305 | 280 |
| Second component | Resin | PE | PE | PE | PE |
| | MFR (g/10 min) | 16 | 16 | 16 | 16 |
| | Melting point (° C.) | 130 | 130 | 130 | 131 |
| | Extrusion temp. (° C.) | 230 | 230 | 230 | 230 |
| Production conditions | Spinning fineness (dtex) | 8.6 | 5.6 | 9 | 16 |
| | Draw ratio | 3.4 | 3 | 3.2 | 5 |
| | Heat treatment temp. (° C.) | 110 | 100 | 80 | — |
| Fiber properties | Fineness based on corrected mass (dtex) | 3.3 | 2.2 | 3.3 | 3.3 |
| | Conjugate rate (1st/2nd) | 60/40 | 40/60 | 50/50 | 50/50 |
| | Additive | $TiO_2$ | $TiO_2$ | $TiO_2$ | — |
| | Addition rate (1st/2nd: %) | 2/3 | 1/0 | 0.4/0 | 0/0 |
| | Fiber cross-section | CSC* | CSC* | CSC* | ESC* |
| | Cross-sectional shape | | | | |
| | Cut length (mm) | 38 | 51 | 51 | 51 |
| | Bulk retention rate (%) | 17 | 14 | 12 | 12 |
| | Shrinkage rate (%) | 2 | 3 | 2 | 6 |
| Nonwoven fabric properties | Mass per unit area ($g/m^2$) | 25 | 26 | 25 | 25 |
| | Thickness (mm) | 2 | 1.8 | 1.5 | 2.3 |
| | Specific volume ($cm^3/g$) | 80 | 70 | 60 | 92 |
| | Softness | B | C | C | D |

*CSC: Concentric sheath core, ESC: Eccentric sheath core

INDUSTRIAL APPLICABILITY

The thermally bonding conjugate fiber of the present invention can maintain the post-heat treatment bulk retention rate thereof at 20% or higher, and therefore the thermally bonding conjugate fiber of the present invention retains crimped form stability even during thermal bonding in the process of making a nonwoven fabric, thereby enabling the production of a nonwoven fabric with a high level of softness and with excellent bulkiness and bulk recovery. More specifically, by the addition of inorganic fine particles, said addition acts synergistically with other constituent elements, so that the conjugate fiber of the present invention provides an advantage that could not be predicted from the original effect of adding inorganic fine particles, i.e., combining bulkiness, bulk recovery, and especially softness while also realizing the advantages of crimped shape stiffness and enhanced thermal stability.

Because the nonwoven fabric obtained from the thermal bonding conjugate fiber of the present invention has not only excellent bulkiness and bulk retention, but also excellent softness, it can be utilized for a variety of applications requiring both bulkiness and softness including diverse fiber formed articles requiring both bulkiness and softness, e.g., absorbent articles such as diapers, napkins, incontinence pads, etc.; medical hygiene supplies such as gowns, scrubs, etc.; interior furnishing materials such as wall coverings, Japanese translucent sliding window paper, floor coverings, etc.; daily living-related materials such as various covering cloths, cleaning wipes, garbage container coverings, etc.; toilet related products such as disposable toilets, toilet seat covers, etc.; pet products such as pet sheets, pet diapers, pet towels, etc.; industrial supplies such as wiping materials, filters, cushioning materials, oil adsorbents, ink tank adsorbents, etc.; general medical supplies; bedding materials; nursing care products; and the like.

The invention claimed is:

1. A thermal bonding conjugate fiber constituted from a first component comprising a polyester resin and a second component comprising a polyolefin resin with a melting point lower than that of the polyester resin by not less than 20° C., characterized in that a post-heat treatment bulk retention rate thereof is 20% or more when calculated by the following measurement method:

$$\text{Bulk retention rate}=(H_1\ (\text{mm})/H_0\ (\text{mm}))\times 100\ (\%)$$

(wherein $H_0$ is the web height when a 0.1 $g/cm^2$ load is applied to a web with a mass per unit area of 200 $g/m^2$; and $H_1$ is the web height after a heat treatment for 5 min at 145° C. when a 0.1 $g/cm^2$ load is applied to the web).

2. The thermal bonding conjugate fiber according to claim 1, characterized in that the shrinkage rate after heat treatment is not more than 3% when calculated by the following measurement method:

$$\text{Shrinkage rate}=\{(25\ (\text{cm})-h_1\ (\text{cm}))/25\ (\text{cm})\}\times 100\ (\%)$$

(wherein $h_1$ is the vertical or horizontal length, which ever is the shorter length, after a heat treatment for 5 min at 145° C. of a 25 cm×25 cm web with a mass per unit area of 200 $g/m^2$).

3. The thermal bonding conjugate fiber according to claim 1 or 2, characterized in that the content of inorganic fine particles in the thermal bonding conjugate fiber is 0.3 to 10 wt %.

4. The thermal bonding conjugate fiber according to any one of claims 1 to 3, characterized in that the polyester resin constituting the first component is at least one selected from the group consisting of polyethylene terephthalate, polypropylene terephthalate, polybutylene terephthalate, polylactic acid, and polybutylene adipate terephthalate.

5. The thermal bonding conjugate fiber according to any one of claims 1 to 4, characterized in that the polyolefin resin constituting the second component is at least one selected from the group consisting of polyethylene, polypropylene, and a copolymer having propylene as the main component thereof.

6. The thermal bonding conjugate fiber according to any one of claims 1 to 5, characterized in that the fiber fineness of the thermal bonding conjugate fiber is 0.9 to 8.0 dtex.

7. The thermal bonding conjugate fiber according to any one of claims 1 to 6, characterized in that the cross-sectional shape of the thermal bonding conjugate fiber is an eccentric cross-section.

8. A process for producing the thermal bonding conjugate fiber according to claim 3, comprising:

adding inorganic fine particles to the first component and/or second component resin and then performing spinning;

establishing a draw ratio of 75 to 90% of the break-draw ratio of the undrawn fibers and establishing a heating temperature in the range of from not less than the glass transition temperature (Tg) of the first component plus 10° C. to not more than the melting point of the second component minus 10° C., and then performing drawing and crimping; and performing a heat treatment at a temperature lower than the melting point of the second component, but not lower in excess of 15° C. than the melting point thereof.

* * * * *